US005488963A

United States Patent [19]

Fishman

[11] Patent Number: 5,488,963

[45] Date of Patent: Feb. 6, 1996

[54] HAIR TWISTING APPARATUS

[75] Inventor: John D. Fishman, Cranston, R.I.

[73] Assignee: Hasbro, Inc., Pawtucket, R.I.

[21] Appl. No.: 233,248

[22] Filed: Apr. 26, 1994

[51] Int. Cl.[6] ..... A45D 8/34

[52] U.S. Cl. ..... 132/212

[58] Field of Search ..... 132/212, 56; 446/472, 446/259

[56] References Cited

U.S. PATENT DOCUMENTS

| | | | |
|---|---|---|---|
| 4,038,996 | 8/1977 | Eronini et al. . | |
| 4,307,737 | 12/1981 | Shipman . | |
| 4,369,690 | 1/1983 | Sapkus . | |
| 4,580,585 | 4/1986 | Sapkus . | |
| 4,582,074 | 4/1986 | Schwager et al. . | |
| 4,583,561 | 4/1986 | Larsson . | |
| 4,824,036 | 4/1989 | Buta | 132/212 X |
| 5,119,847 | 6/1992 | Powell et al. | 132/226 |

FOREIGN PATENT DOCUMENTS

| | | | |
|---|---|---|---|
| 538169 | 4/1993 | European Pat. Off. | 446/296 |

*Primary Examiner*—John G. Weiss
*Attorney, Agent, or Firm*—Kurt R. Benson

[57] ABSTRACT

A hair twisting apparatus includes a housing, a jaw assembly on the housing and a trigger on the housing which is operable for twisting the jaw assembly to twist a group of hair strands received therein. The apparatus includes an elastic band on the jaw assembly for retaining first and second jaw elements thereof in gripping engagement on a group of hair strands during twisting thereof and a slidable shaft mechanism which is forwardly advanceable for moving the elastic band from the jaw assembly onto the terminal end portion of the group of hair strands for retaining the hair strands in a twisted condition.

7 Claims, 4 Drawing Sheets

HAIR TWISTING APPARATUS

BACKGROUND AND SUMMARY OF THE INVENTION

The instant invention relates to hair styling apparatus and more particularly to a hair twisting apparatus which is operable by a young child for styling the hair of a toy doll.

A variety of different types of hair styling devices have been heretofore available for twisting or braiding the hair of humans and/or dolls. In this regard, the U.S. Pat. Nos. to Eronini et al, No. 4,038,996; Sapkus, No. 4,369,690; Shipman, No. 4,307,737; Sapkus, No. 4,580,585; Schwager et al, No. 4,582,074; and Larson, No. 4,583,561 disclose various types of hair twisting and/or braiding apparatus which represent the closest prior art to the subject invention of which the applicant is aware. However, the apparatus disclosed in these references are in generally relatively complicated, and, in general, they cannot be readily and easily operated by young children. Further, the apparatus disclosed in these references are not capable of effectively applying retaining elements to quantities of twisted or braided hair strands in order to retain the strands in a twisted or braided condition. Instead, they have required users to perform relatively awkward manipulative operations to apply retaining members to groups of twisted or braided hair strands, and this has further contributed to making the heretofore available apparatus unsuited for use by young children.

The instant invention provides a highly effective hair twisting apparatus which is capable of being easily operated by a young child for styling the hair of a toy doll. More specifically, the instant invention provides a hair twisting apparatus which is easily operable by a young child for first twisting a group of hair strands and for then applying an elastic band to the terminal portion of group of twisted hair strands in order to maintain the group of hair strands in a twisted condition. Still more specifically, the hair twisting apparatus of the instant invention comprises a housing including a handle portion which is configured to be held in a hand of a user, a pivotable trigger on the handle portion, and a jaw assembly on a forward end of the housing. The apparatus further includes an operating mechanism for operatively coupling the trigger to the jaw assembly such that pivoting of the trigger inwardly toward the handle portion causes rotation of the jaw assembly about a twisting axis. The apparatus still further comprises an elastic band applicator mechanism for applying an elastic band to the terminal portion of a group of hair strands in order to maintain the hair strands in a twisted condition. The Jaw assembly comprises first and second jaw elements which are biased to a closed position with an elastic band, and the means for applying an elastic band to a quantity of hair strands comprises an elongated shaft which is operative for moving the elastic band from the jaw elements onto the hair strands either before or after the hair strands have been twisted with the apparatus. The shaft is preferably forwardly moveable along a twisting axis, and the first jaw element preferably has a channel formed therein which accommodates the shaft as the shaft is moved forwardly along the twisting axis. The second jaw element is preferably pivotally attached to the first jaw element, and accordingly, the second jaw element rotates about both the first jaw element and the twisting axis as the jaw assembly is rotated in response to pivoting the trigger element. The second jaw element preferably also includes a recess on an outwardly facing side thereof for releasably retaining an elastic band on the first and second jaw elements prior to assembling the elastic band onto a group of hair strands. Further, the shaft is preferably mounted so that an actuator button thereof is exposed at a rear end of the housing to enable a user to engage the rear end portion of the shaft to advance the shaft forwardly in order to move the elastic band from the jaw assembly onto a quantity of twisted hair strands.

It has been found that the hair twisting apparatus of the instant invention can be effectively utilized by a young child for styling the hair of a toy doll. In this regard, the jaw assembly is adapted for quickly and easily receiving an elastic band thereon so as to maintain the jaw elements in a closed gripping position. Thereafter, the jaw assembly can be effectively utilized for grasping a quantity of hair, and by then operating the trigger on the apparatus to rotate the jaw assembly, the hair can be quickly and easily twisted. Thereafter, while the hair is still held in the jaw assembly, the shaft can be moved forwardly to disengage the elastic band from the jaw elements and to slide the elastic band onto the terminal end portion of the group of twisted hair strands in order to retain the hair strands in a twisted condition. The group of twisted hair strands can then be folded back on itself to cause the twisted group of hair strands to twist on itself.

Accordingly, it is a primary object of the instant invention to provide an effective hair styling device which is operable by a young child for styling a the hair of a doll.

Another object of the instant invention is to provide a hair styling device which is operative for twisting a group of hair strands and for thereafter applying an elastic band to the hair strands to maintain them in a twisted condition.

An even still further object of the instant invention is to provide a hair twisting apparatus comprising a jaw assembly which is adapted to be held in a closed position with an elastic band and a shaft which is operative for disengaging the elastic band from the jaw assembly and for positioning it on a group of twisted hair strands held in the jaw assembly.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 3:
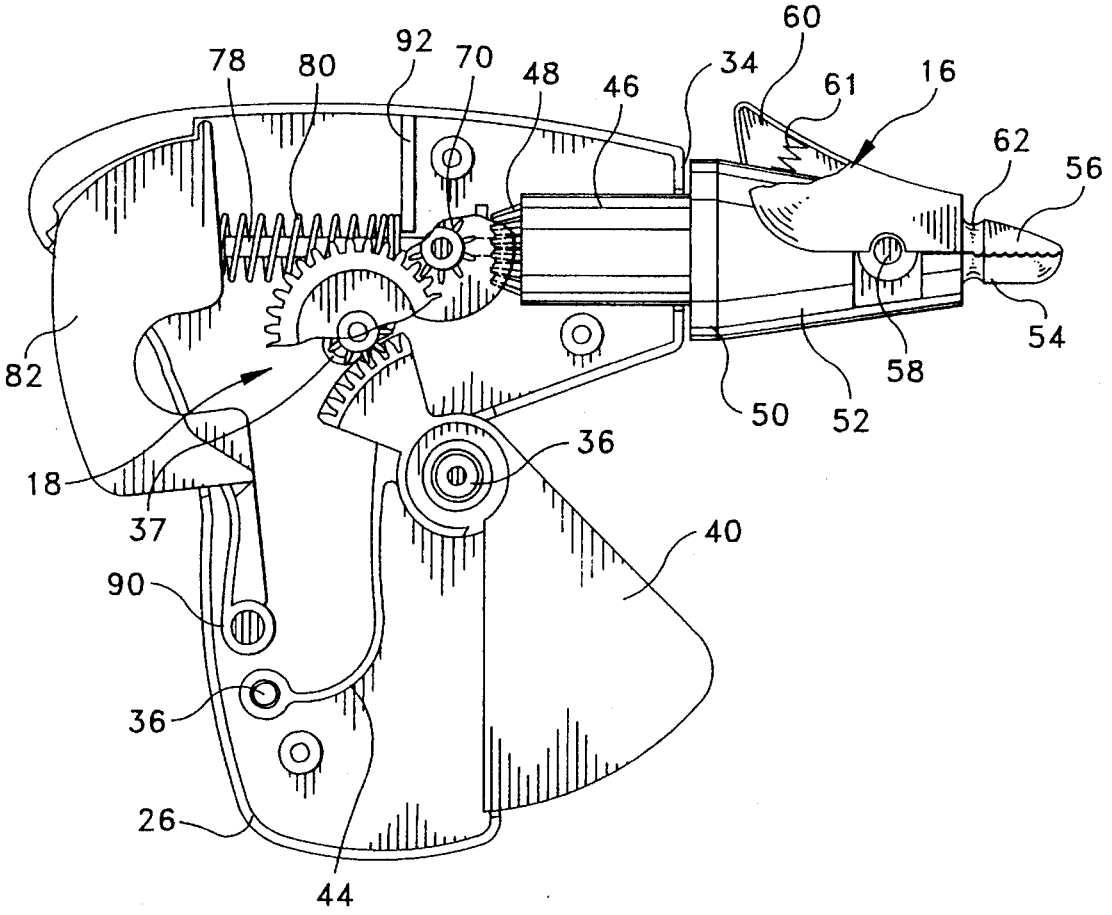
FIG. 3 is an enlarged side elevational view thereof with one side of the housing removed.
Figure 4:
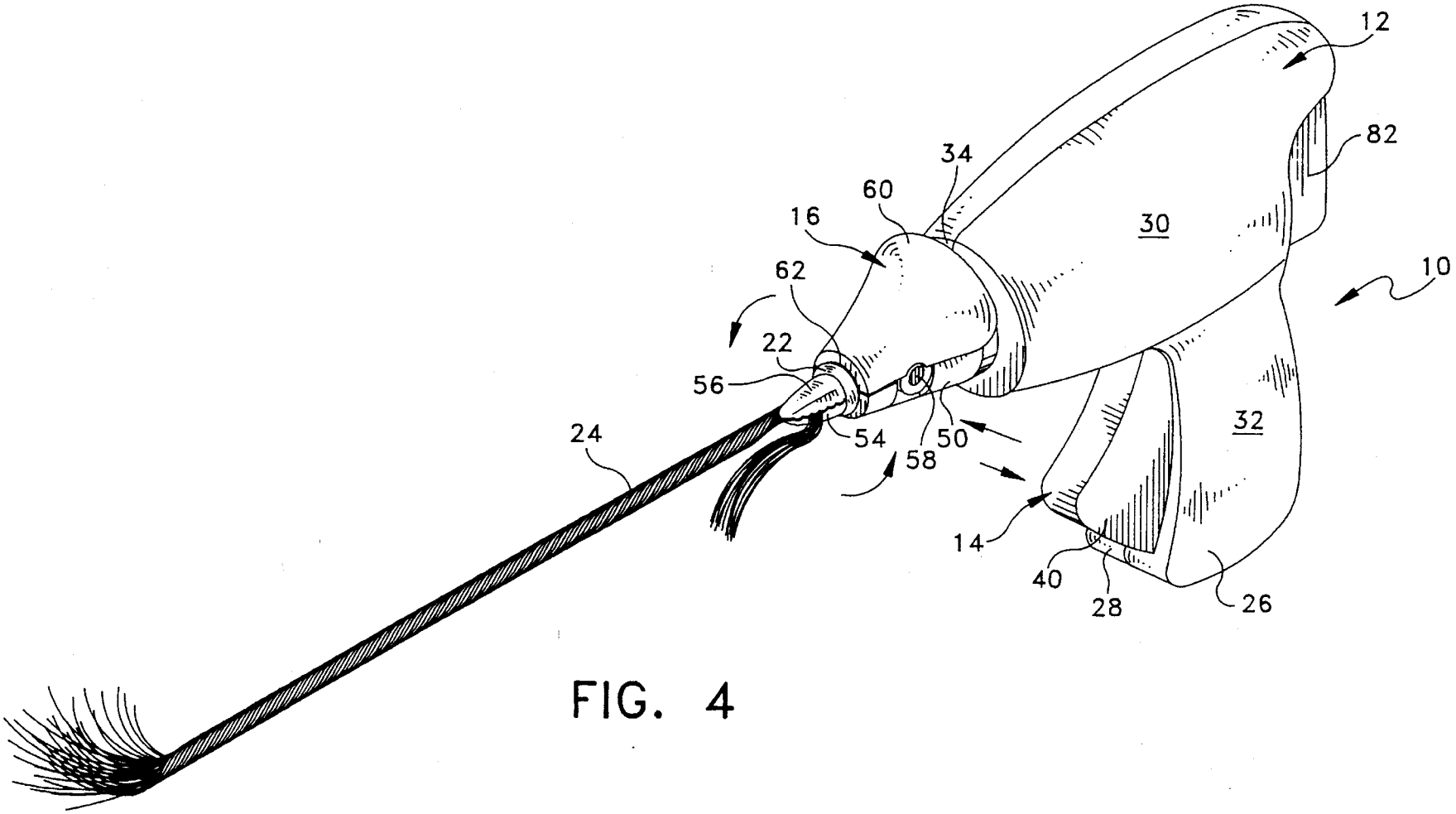
FIG. 4 is a perspective view illustrating the operation of the twisting apparatus for twisting a group of hair strands.
Figure 5:
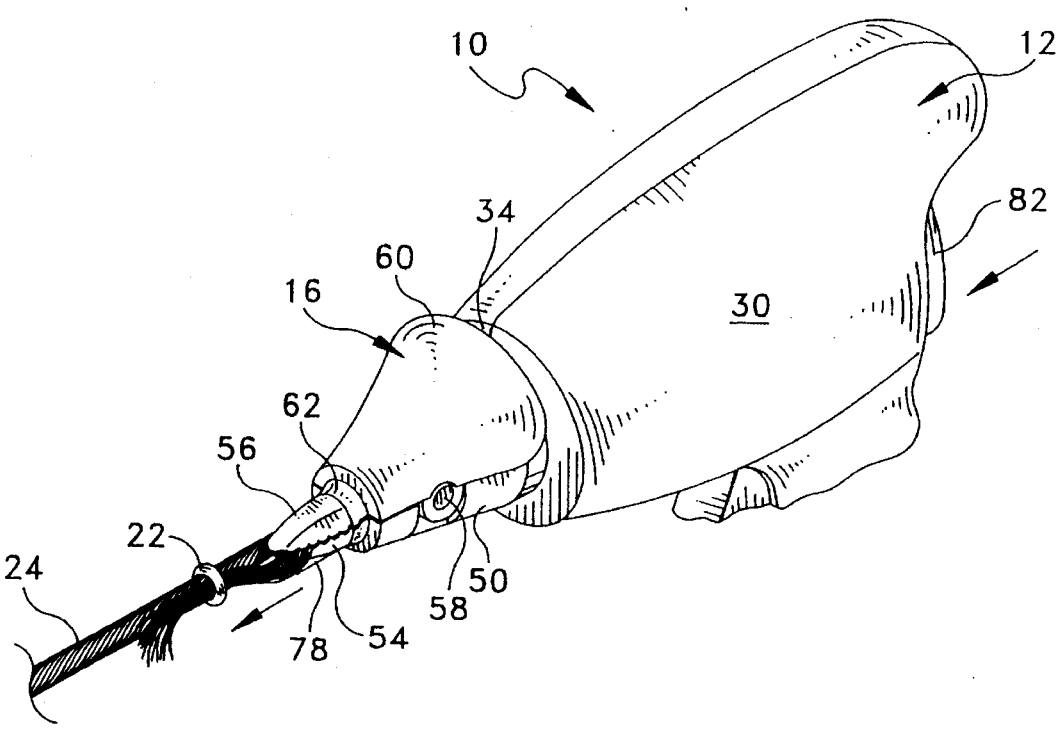
FIG. 5 is a perspective view thereof illustrating the application of an elastic band to the hair strands.

Referring now to the drawings, the apparatus of the instant invention is illustrated and generally indicated at 10 in FIGS. 1 through 5. The apparatus 10 comprises a housing or body portion generally indicated at 12, a trigger assembly generally indicated at 14 on the housing 12, a jaw assembly generally indicated at 16 on the housing 12, a gear mechanism generally indicated at 18, and an elastic band transfer mechanism generally indicated at 20. The jaw assembly 16 is adapted for receiving an elastic band 22 thereon in order to assure that the jaw assembly 16 is maintained in a closed or grasping position. However, once a rubber band 22 has been received on the jaw assembly 16, the jaw assembly 16 can be utilized for grasping a group of hair strands 24 in order to twist the group of hair strands 24 with the apparatus 10 in the manner illustrated in FIG. 4. Specifically, the apparatus 10 is operative by pivoting the trigger 14 in the manner illustrated for driving the gear assembly 18 to rotate the jaw assembly 16 about a twisting axis so as to twist the group of hair strands 24. Thereafter, as illustrated in FIG. 5, the transfer mechanism 20 can be operated for transferring the elastic band 22 from the jaw assembly 16 to the group of hair strands 24 in order to maintain the hand strand 24 in a twisted condition.

Figure 1:
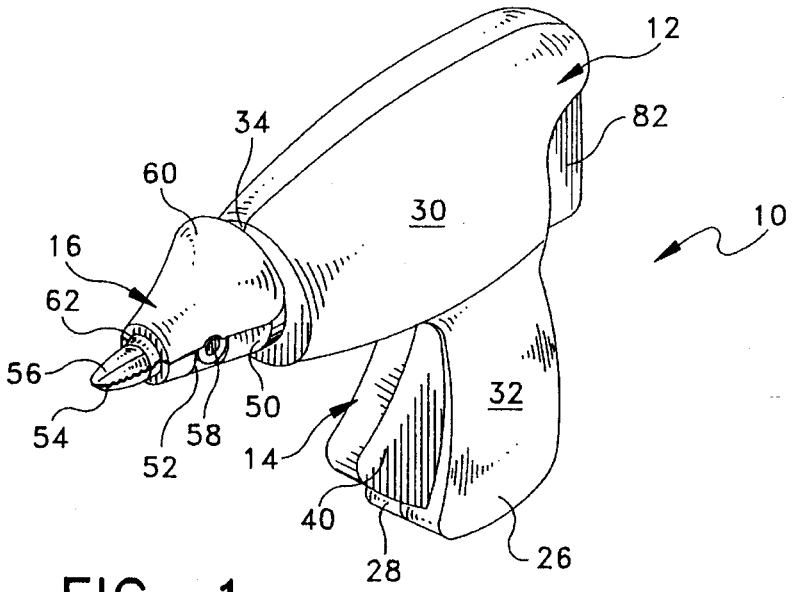
FIG. 1 is a perspective view of the twisting apparatus of the instant invention.
Figure 2:
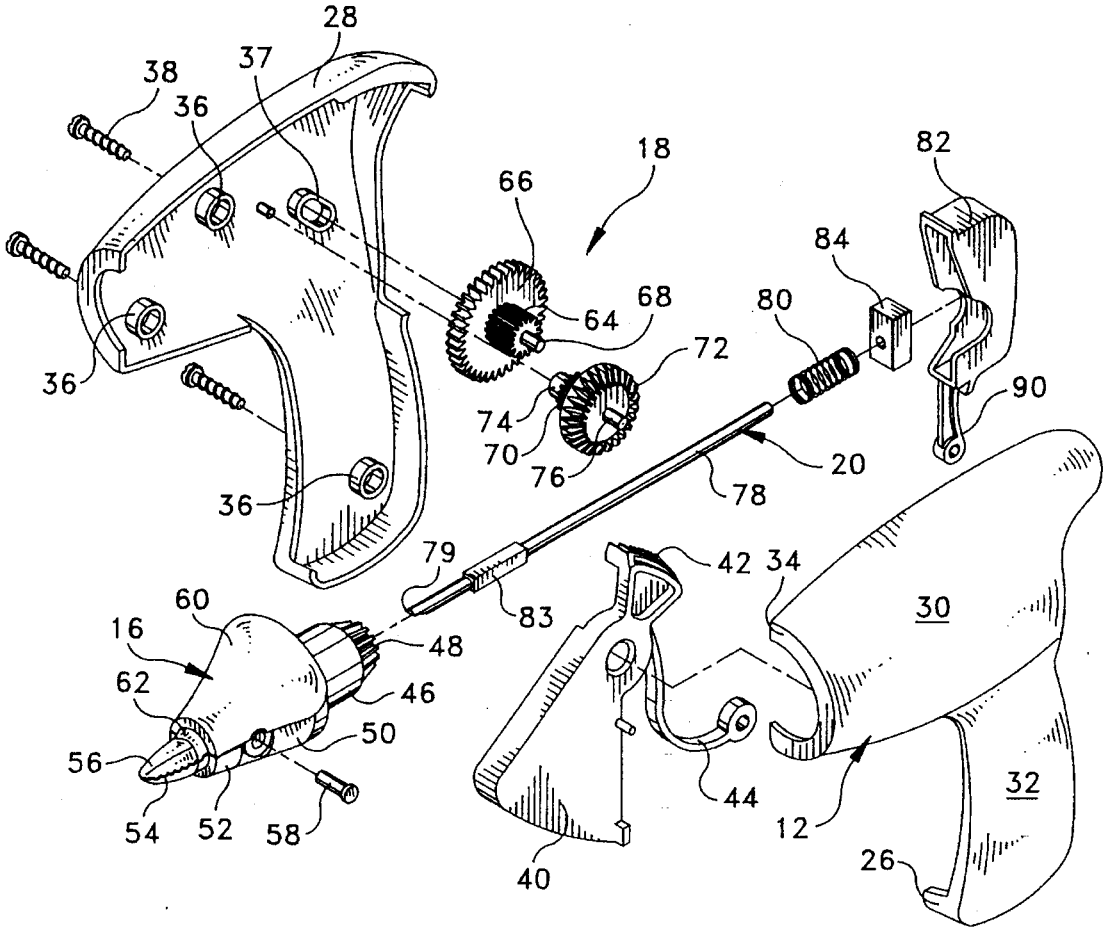
FIG. 2 is an exploded perspective view thereof.

The housing 12 comprises first and second housing sections 26 and 28, respectively, which cooperate to define a main or upper portion 30 and a lower or handle portion 32. The housing 12 includes a forwardly projecting circular neck portion 34, and the housing sections 26 and 28 each have a plurality of circular mounting bosses 36 and an elongated or oval mounting boss 37 formed in the respective interior thereof. The housing sections 26 and 28 are maintained in assembled relation by a plurality of screws 38 as illustrated in FIG. 2.

The trigger 14 includes a main trigger element 40 which is pivotally mounted on one of the mounting bosses 36. The trigger 14 further comprises a gear segment 42 which is integrally formed with the main portion 40 and a return spring portion 44 which is also integrally formed with the main portion 40. As illustrated in FIG. 3, the return spring portion 44 is received on one of the mounting bosses 36, and the return spring portion 44 is operative for biasing the trigger 14 to the position illustrated in FIG. 3. However, by manually drawing the main portion 40 rearwardly into the handle portion 32 the trigger 14 can be pivoted to cause the gear segment 42 to drive the gear assembly 18 for rotating the jaw assembly 16.

The jaw assembly 16 comprises a base portion 46 having a spur gear 48 integrally formed thereon and a neck portion 50 which is rotatably mounted in the neck portion 34 of the housing 12. The jaw assembly 16 further comprises a tubular front portion 52 and a lower jaw element 54 which cooperates with the tubular front portion 52 to define a forwardly extending tubular passage which extends forwardly from the neck portion 50. The neck portion 50 and the base portion 46 also have an axial passage extending therethrough which is formed as a tubular extension of the passage defined by the forward tubular portion 52 and the lower jaw portion 54. The jaw assembly 16 further comprises an upper jaw portion 56 which is pivotally attached to the lower jaw portion 54 about a pivot axis 58. The upper jaw portion 56 includes a thumb lever 60 which is movable against a spring 61 for moving the jaw assembly 16 to an open position, and a retaining recess 62 is formed on the upper jaw element 56 for releasibly retaining an elastic band 22 on the jaw assembly 16 as illustrated in FIG. 4. The gear mechanism 18 comprises a primary pinion gear 64 which is received in engagement with the gear segment 42. The primary pinion gear 64 is integrally formed with a concentric transfer gear 66, and the gears 64 and 66 are integrally formed on a common mounting shaft 68. The mounting shaft 68 is received in the oval-shaped bosses 37 provided in the housing sections 26 and 28 as illustrated. Also included in the gear mechanism 18 is a secondary-pinion gear 70 which is integrally formed with a bevel gear 72. The gears 70 and 72 are integrally formed with a socket 74 and a shaft 76 which are rotatably received on mating elements in the housing sections 26 and 28 in order to rotatably mount the gears 70 and 72 in fixed positions in the housing 12. The crown gear 72 is received in meshing engagement with the spur gear 48 for rotating the jaw assembly 16 as the gears 70 and 72 are rotated. However, because the shaft 68 is received in the oval-shaped bosses 37 in the housing sections 26 and 28, the transfer gear 66 is moved into and out of engagement with the secondary pinion gear 70 depending on the direction of movement of the gear segment 42. Specifically, as the trigger portion 40 is drawn inwardly into the handle portion 32 to move the gear segment 42 in a direction generally toward the jaw assembly 16, the transfer gear 66 is brought into meshing engagement with the secondary gear 70. Accordingly, as the trigger portion 40 is drawn inwardly into the handle portion 32, the segment gear 42 rotates the gears in the gear assembly 18 to in turn rotate the jaw assembly 16. On the other hand, when the trigger portion 40 is released so that it is resiliently returned to a forward position by the spring portion 44, the gear segment 42 urges the primary pinion gear 64, along with the transfer gear 66 and the shaft 68, to a downward position in the oval-shaped boss 37 so that the transfer gear 66 is disengaged from the secondary pinion gear 70. Consequently, the jaw assembly 16 is not rotated as the trigger portion 40 is returned to an outward position on the handle portion 26. As a result, it is possible to repeatedly draw the handle portion 40 inwardly to rotate the jaw assembly 16 in stepped increments in a single direction of rotation without causing it to rotate in a reverse direction.

The transfer mechanism 20 comprises a transfer shaft 78 having scoop-shaped forward end 79, a return spring 80, a rear button portion 82 and an inner block 84. The shaft 78, which includes a noncircular portion 83, is assembled so that the front end portion thereof slidably, but nonrotatably extends through the tubular passage in the jaw assembly 16, and the spring 80, the inner block 84 and the button portion 82 are received on the rear end portion of the shaft 78. The button portion 82 extends through the rear wall of the housing 12, and it includes a mounting arm 90. The spring 80 extends between the inner block 84 and an interior wall 92 in the housing section 26 so that it is operative for biasing the button portion 82 to an outwardly extended position.

The elastic band 22 comprises a conventional elastic band, and it is dimensioned to be received on the jaw assembly 16 in the manner illustrated in FIG. 4 for biasing the jaw elements 54 and 56 together in a gripping position. The elastic band 22 must also be formed in a sufficiently small diameter to enable it to be effectively utilized for retaining a group of hair strands 24 in a twisted orientation. In other words, the elastic band 22 must be of a sufficiently small diameter so that it can be received on a group of hair strands 24 and resiliently retained thereon by the elasticity of the band 22.

Figure 6:
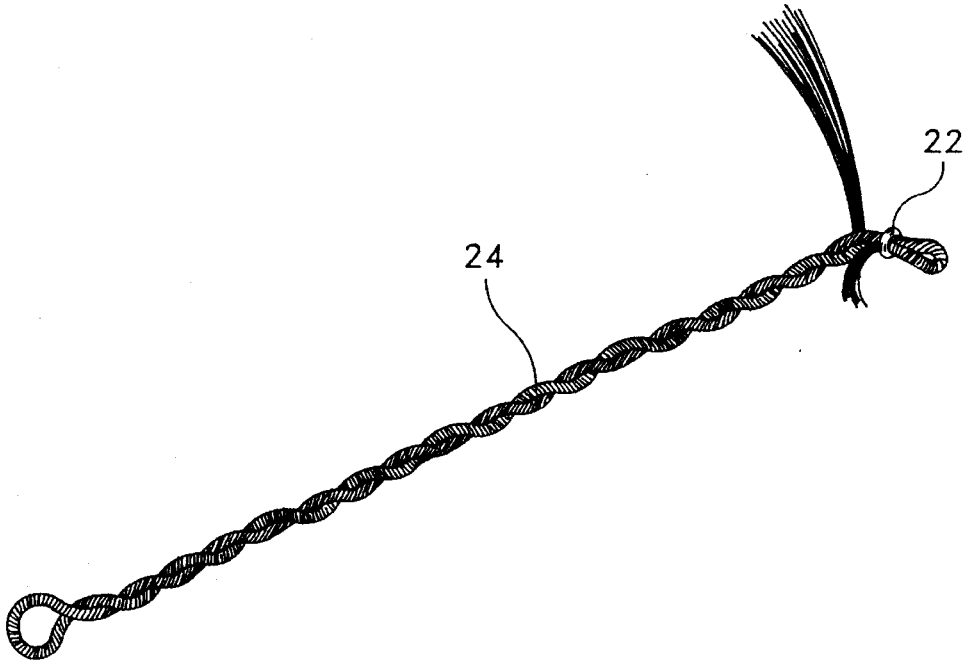
FIG. 6 is a perspective view illustrating a group of hair strands as twisted with the apparatus.

Accordingly, for use and operation of the apparatus 10 an elastic band 22 is assembled on the jaw assembly 16 so that the elastic band 22 biases the jaw portions 54 and 56 to a closed position. The jaw assembly 16 is then pivoted to an open position by pressing downwardly on the thumb lever 60 to open the jaw elements 54 for receiving a group of hair strands 24 therein. Once the hair strands 24 have been received between the jaw elements 54 and 56, the jaw assembly 16 can be pivoted to a closed position wherein the jaw elements 54 and 56 are retained in clamping engagement on the hair strands 24 by the elastic band 22. Thereafter, the trigger portion 40 can be repeatedly drawn inwardly and released to rotate the jaw assembly 16 and the shaft 78 about the twisting axis defined by the shaft 78 and to thereby twist the hair strands 24. Once the hair strands 24 have been twisted a sufficient amount, the button 82 can be pressed inwardly into the housing 12 to cause the shaft 78 to be advanced through the jaw assembly 16 and outwardly along the lower edge of the lower jaw 54. This causes the elastic band 22 to be disengaged from the jaw assembly 16 and repositioned on the terminal end portion of the hair strands 24 for retaining the hair strands in a twisted orientation. The bundle of hair strands 24 can thereafter be twisted over onto itself so that the twisted bundle of strands twists onto itself to provide a doubled-over twisted bundle of hair strands of the type illustrated in FIG. 6.

It is seen therefore that the instant invention provides an effective apparatus for twisting hair strands. The apparatus 10 can be effectively utilized for grasping a group of hair strands 24, and by thereafter manipulating the trigger portion 40 the group of hair strands can be effectively twisted. Further, by thereafter operating the transfer mechanism 20 the elastic band 22 can be transferred from the jaw assembly 16 onto the terminal end portion of the group of hair strands to retain the group of hair strands in a twisted orientation. Further, once the elastic band 22 has been transferred onto the hair strands 24, the jaw assembly 16 is automatically released from the hair strands 24, although the jaw assembly 16 is still held in a closed position by the spring 61. Hence it is seen that the instant invention provides an effective hair twisting apparatus which can be simply and easily operated by a young child and which therefore represents a significant improvement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hair twisting apparatus comprising a housing including a handle portion configured to be held in a hand of a user;

a pivotable trigger on said handle portion, said trigger being biased toward an outwardly pivoted position on said handle portion;

axially rotatable jaw means at a forward end of said housing for releasably grasping a quantity of hair;

means for operatively coupling said trigger to said jaw means such that manually pivoting said trigger on said handle portion causes rotation of said jaw means about a twisting axis; and means for applying an elastic band to said quantity of hair after twisting thereof by passing said elastic band forwardly and outwardly over at least a portion of said jaw means and onto said quantity of hair.

2. In the hair twisting apparatus of claim 1, said jaw means comprising opposed first and second jaw elements and said elastic band, said elastic band biasing said first and second jaw elements together while twisting said quantity of hair, said means for applying said elastic band being operative for thereafter moving said elastic band onto said quantity of hair.

3. In the hair twisting apparatus of claim 1, said jaw means comprising opposed first and second jaw elements and said elastic band, said elastic band being received on said first and second jaw elements for biasing said first and second jaw elements together while twisting said quantity of hair, said means for applying said elastic band being operative for thereafter moving said elastic band onto said quantity of hair.

4. In the hair twisting apparatus of claim 3, said means for applying said elastic band comprising a forwardly slidable shaft in said housing, said shaft being slidable forwardly along one of said jaw elements for moving said elastic band forwardly onto said quantity of hair.

5. In, the hair twisting apparatus of claim 4, said shaft being movable forwardly along said twisting axis, said first jaw element rotating about said twisting axis in response to pivoting said trigger, said second jaw element being pivotally attached to said first jaw element and rotating about said twisting axis in response to pivoting said trigger.

6. In the hair twisting apparatus of claim 5, said second jaw element having inwardly and outwardly facing sides, the inwardly facing side of said second jaw element facing the inwardly facing side of said first jaw element, said second jaw element including a retaining recess on the outwardly facing side thereof for releasably retaining said elastic band on said first and second jaw elements.

7. In the hair twisting apparatus of claim 4, said shaft extending through said housing and including a rear end portion which is exposed at a rear end of said housing, said rear end portion being forwardly movable into said housing for moving said elastic band from said jaw elements onto said quantity of hair.

* * * * *